US009101254B2

(12) United States Patent
Almendros Carmona et al.

(10) Patent No.: US 9,101,254 B2
(45) Date of Patent: Aug. 11, 2015

(54) DISHWASHER, PARTICULARLY HOUSEHOLD DISHWASHER

(75) Inventors: Ismael Jesus Almendros Carmona, Pamplona (ES); Helmut Jerg, Giengen (DE); Roberto Lizoain Mendoza, Aoiz (ES); Koldo Urdiain Yoldi, Estella (ES)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 937 days.

(21) Appl. No.: 13/320,915

(22) PCT Filed: Apr. 29, 2010

(86) PCT No.: PCT/EP2010/055785

§ 371 (c)(1),
(2), (4) Date: Nov. 17, 2011

(87) PCT Pub. No.: WO2010/136293

PCT Pub. Date: Dec. 2, 2010

(65) Prior Publication Data

US 2012/0060871 A1 Mar. 15, 2012

(30) Foreign Application Priority Data

May 28, 2009 (DE) ..... 10 2009 026 547

(51) Int. Cl.
*A47L 15/42* (2006.01)
*D06F 39/08* (2006.01)

(52) U.S. Cl.
CPC ..... *A47L 15/4212* (2013.01); *D06F 39/081* (2013.01)

(58) Field of Classification Search
None
See application file for complete search history.

(56) References Cited

U.S. PATENT DOCUMENTS

| | | | |
|---|---|---|---|
| 7,464,720 | B2 | 12/2008 | Yoon et al. |
| 2008/0055112 | A1 | 3/2008 | McGinty et al. |
| 2010/0126235 | A1 | 5/2010 | Bolduan et al. |

FOREIGN PATENT DOCUMENTS

| | | | |
|---|---|---|---|
| CN | 101164489 | A | 4/2008 |
| EP | 2026690 | B1 | 1/2012 |

OTHER PUBLICATIONS

International Search Report PCT/EP/2010/055785.
Chinese National Search Report CN 201080023270.4 dated May 27, 2013.

*Primary Examiner* — Jason Ko
(74) *Attorney, Agent, or Firm* — James E. Howard; Andre Pallapies

(57) ABSTRACT

A dishwasher includes a tub and a bottom assembly disposed below the tub and including at least one fluid collection apparatus having a main reservoir with a fluid overflow safety unit and at least one additional intermediate reservoir for collecting leakage and/or overflow fluid from the tub and/or at least one fluid-conducting component. The additional intermediate reservoir is disposed and configured such that solid particles contained in the leakage and/or overflow fluid can largely be deposited and/or retained in the at least one additional intermediate reservoir. The additional intermediate reservoir is connected to the main reservoir by at least one run-off to conduct fluid out of the additional intermediate reservoir into the main reservoir when a predetermined fill level top limit in the additional intermediate reservoir is exceeded, with the run-off having a gradient from the intermediate reservoir to the main reservoir.

28 Claims, 2 Drawing Sheets

DISHWASHER, PARTICULARLY HOUSEHOLD DISHWASHER

BACKGROUND OF THE INVENTION

In practice it can in some instances come about that fluid, in particular wash liquor fluid, exits, in particular drips down from, the interior of the tub and/or at least one fluid-conducting component of a dishwasher, in particular a household dishwasher. The wash liquor fluid can be formed, depending on the cleaning step of an ongoing dishwashing program of the dishwasher currently being performed, in particular by fresh water, used or dirty water, or fresh and/or used water containing one or more detergent, salt and/or rinse aid substances. Wash liquor fluid can exit from the tub for example in the form of sprayed water by way of at least one overflow line, when the fluid level in the tub exceeds a predetermined permissible level top limit. Condensate and/or vaporized fluid can also get out through at least one pressure equalization opening in the tub or in its door, if overpressures and bursts of steam are produced in the tub during the respective wash liquor fluid heating process, for example in the prewash step, cleaning step and/or final rinse step. Finally fluid, in particular liquid, such as for example water, preferably wash liquor fluid, can also drip down in an unwanted manner due to leakages, for example in the connecting region between the bottom element and the respective side wall, door and/or rear wall of the tub. Additionally or independently hereof leakage fluid can also drip out of at least one leak in at least one other fluid-conducting component, in particular a hydraulic component of the fluid circulation system, of the dishwasher, for example its circulation pump, drain pump, discharge line, pump sump, regeneration container, ion exchanger container, water trap, water supply lines, water discharge lines, etc. This leakage and/or overflow fluid exiting from the tub and/or a fluid-conducting component is generally collected by a trough-type collector in a bottom assembly below the tub. The trough-type collector here is fitted with a fluid overflow safety unit, for example a safety system with a float. All the leakage and/or overflow fluid that drips into the trough-type collector is collected in the collector. If the fluid level of the collected fluid in the trough-type collector exceeds a certain trigger level limit, the float of the fluid overflow safety unit responds and triggers a control signal for the control apparatus of the dishwasher, upon which it closes the water inlet apparatus of the dishwasher and activates its drain pump to pump off the fluid from the tub.

In some practical conditions undesirable malfunctions, in particular impairments of the trigger and/or response behavior, of the fluid overflow safety system occur. Thus it can come about for example that the float of the fluid overflow safety unit does not rise quickly enough or at all from the base of the trough-type collector, even though the fluid collecting there has already exceeded a critical level range, requiring the blocking or stopping of the water inlet apparatus and in some instances the drain pump.

BRIEF SUMMARY OF THE INVENTION

One object underlying the invention is to provide an improved dishwasher, in particular household dishwasher, which reliably ensures correct operation, in particular desired response behavior and/or trigger behavior, of the fluid overflow safety unit. In particular fast-response triggering of the fluid overflow safety system is desired, when more than a certain, permissible quantity of fluid exits, preferably in an unwanted manner, from the tub and/or at least one other fluid-conducting component of the dishwasher.

According to the invention this object is achieved by the following dishwasher: a dishwasher, in particular a household dishwasher, having a bottom assembly below its tub, which features at least one fluid collection apparatus for collecting leakage and/or overflow fluid from the tub and/or from at least one fluid-conducting component, wherein the fluid collection apparatus comprises a main reservoir having a fluid overflow safety unit and one or more additional intermediate reservoirs and wherein the one or more additional intermediate reservoirs for collecting leakage fluid and/or overflow fluid from the tub and/or the respectively fluid-conducting component are disposed and configured in such a manner that solid particles contained in the leakage and/or overflow fluid can largely be deposited and/or retained in the one or more intermediate reservoirs.

The one or more additional intermediate reservoirs ensure, in instances where fluid overflows and/or leaks from the tub and or exits from at least one other fluid-conducting component, that any solid particles contained in the respective overflow fluid and/or leakage fluid are largely, i.e. partially or wholly, deposited in the one or more intermediate reservoirs and/or are retained there before flowing into the main reservoir. By depositing and/or retaining a partial quantity or the entire quantity of solid particles of the leakage fluid and/or overflow fluid exiting from the tub and/or the respective fluid-conducting component in the one or more intermediate reservoirs it is largely possible to prevent too may solid particles accumulating in the main reservoir where they could have an impermissibly adverse effect on or interfere with the overflow safety function of the fluid overflow safety unit, in particular its response and/or trigger behavior. In other words by dividing the fluid collection apparatus into a main reservoir and one or more additional intermediate reservoirs it is possible to keep the main reservoir largely clear of solid particles, in other words to prevent impermissibly extensive soiling of the main reservoir and/or the fluid overflow safety unit provided therein. It may therefore come about less frequently or not at all that solid particles adhere to the fluid collection apparatus, in particular its float, or even become fixed to the bottom region of the main reservoir, thereby impairing or even preventing the correct movement of the fluid collection apparatus, in particular its float.

Providing one or more intermediate reservoirs in addition to the main reservoir allows at least a partial quantity of any solid particles present in the fluid to drop to the base of the respective intermediate reservoir, in particular due to their own weight. However in addition to or independently of this the solid particles can primarily be deposited on the bottom and/or side walls of the respective intermediate reservoir due largely to evaporation of the fluid. The fluid accumulated in the respective intermediate reservoir can therefore evaporate there after a while, in particular during the time period in which the dishwasher is out of operation or in the time period between two dishwashing programs in which no water is supplied, and the solids contained therein, such as floating matter, dirt and/or other impurities such as food residues, dust particles, detergent, rinse aid and/or salt residues are left behind as sediment in the bottom region and/or as deposits in the side wall region of the intermediate reservoir. This largely prevents an impermissibly large quantity of sump products adhering to the fluid overflow safety unit in the main reservoir, in particular its float, or remaining fixed in the bottom region of the main reservoir. This ensures the correct movement of the fluid overflow safety unit, in particular its float, for a sufficiently long operating period, preferably the entire service life of the dishwasher. Both depositing effects are preferably favored, if the fluid accumulated in the respective intermediate reservoir does not exceed the predetermined fill level top limit, i.e. the capacity of the intermediate reservoir, and remains in this, i.e. does not yet run into the main reservoir or overflow into it. However even if the fluid collected in the respective intermediate reservoir becomes excessive and after exceeding the fill level top limit specific to the intermediate reservoir runs, in particular overflows, out of the intermediate reservoir into the main reservoir, the respective intermediate reservoir ensures at least separation and/or mechanical retention of solid particles and therefore a sort of preliminary clearing or cleaning of solid particles from the fluid accumulated therein.

This allows correct overflow safety operation of the fluid overflow safety unit to be maintained over an operating period of the dishwasher that is sufficiently long in practice—in particular over a longer service life period of the dishwasher than with previous designs, which only feature an individual, trough-type collector—without costly maintenance measures; in other words safety impairment or malfunction of the fluid overflow safety unit is largely prevented. In the event that there should actually be an overflow of fluid from one or more intermediate reservoirs into the main reservoir and a certain predetermined trigger level is exceeded there, the fluid overflow safety unit can be reliably activated. Additional ongoing maintenance, in particular cleaning of the main reservoir and/or its fluid overflow safety unit is required much less frequently than previously, in other words only seldom or not at all.

Within the context of the invention fluid refers in particular to a liquid, e.g. fresh water, used water or fresh and/or used water with one or more detergent, salt and/or rinse aid substances added. It can in some instances contain solid particles such as for example dirt, floating matter and/or other impurities, such as for example food residues, fluff, dust and/or dishwasher detergent residues, dishwasher cleaning agents residues, rinse aid residues, salt particles, etc.

The respective additional intermediate reservoir is expediently provided in a spatially separate manner at a different location from the main reservoir outside it in the fluid collection apparatus. Such separation of the main reservoir and respective intermediate reservoir allows the main reservoir advantageously to be kept particularly clear of solid particles. In particular the respective intermediate reservoir can preferably be disposed independently of the main reservoir where experience has shown that a leak or lack of leak tightness and/or an overflow point of the tub and/or a fluid-conducting component may occur. In particular the separation of the surfaces of the main reservoir and respective additional intermediate reservoir allows a flat, preferably plate-like geometric shape to be achieved for the fluid collection apparatus, which takes up only a little space in the bottom assembly of the dishwasher. In particular it can be provided there as the lowest bottom plane. Generally speaking the respective intermediate reservoir and the main reservoir can thus be integral components of the fluid collection apparatus of the bottom assembly.

In particular if a number of intermediate reservoirs are provided, more leakage and/or overflow fluid can be collected for evaporation in the fluid collection apparatus. This makes it easier to prevent dirt, floating matter and/or other impurities, such as for example food residues, fluff, dust and/or dishwasher detergent, dishwasher cleaning agents, rinse aid, salt particles, etc. getting into the main reservoir in undesirable quantities, where they would otherwise form sump products to an undesirable degree, these possibly being associated with malfunctions or impairments of the fluid overflow safety unit.

At least two intermediate reservoirs, in particular their bottom regions, can preferably be disposed at different height levels. This allows the accumulated fluid in the various intermediate reservoirs to flow out of said intermediate reservoirs when their capacity is exceeded at different, specifically assigned flow speeds. This allows a distinction to be made between more critical and less critical intermediate reservoirs depending on the origin of the leakage and/or overflow fluid. To this end it can in particular also be expedient if the bottom region of at least one intermediate reservoir and the bottom region of the main reservoir are disposed at different height levels. The bottom region of the respective intermediate reservoir can preferably be disposed closer to the tub than the bottom region of the main reservoir in order to provide a natural gradient.

It can in particular be expedient to provide intermediate reservoirs of different depths and/or intermediate reservoirs of different capacities. This allows a differentiated accumulation of leakage and/or overflow fluid from the tub and/or at least one fluid-conducting component. Thus for example a larger intermediate reservoir can be provided in the fluid collection apparatus below any leakage in the corner region of the tub of the dishwasher than for a leak below the pump sump of the tub.

It can in particular be expedient if the main reservoir and/or the one or more intermediate reservoirs are molded as hollows or flat tray-shaped depressions or indentations in a common, flat, in particular trough-type bottom element. This provides a sufficiently large evaporation surface.

According to one expedient development of then invention each intermediate reservoir is connected to the main reservoir by way of at least one run-off, in particular guide channel, to conduct fluid out of the respective intermediate reservoir, when its maximum volume is exceeded, into the main reservoir. It is particularly advantageous here if the overflow of leakage and/or overflow fluid, in particular wash liquor fluid, runs in a directed manner out of the respective intermediate reservoir to the main reservoir, in which the fluid overflow safety unit is disposed. This allows fast and effective triggering of the fluid overflow safety unit. This is ensured even if the bottom assembly and therefore also the dishwasher are not aligned absolutely level, i.e. horizontally. The guide channel between the respective intermediate reservoir and the main reservoir ensures that fluid or liquid exiting from the intermediate reservoir, in particular wash liquor fluid, is guided directly and in a directed manner to the fluid overflow safety unit of the main reservoir. This allows the fluid overflow safety unit of the main reservoir to stop the water supply to the dishwasher, if more fluid is exiting from the tub than the respective intermediate reservoir can hold.

The bottom assembly of the dishwasher, in particular the household dishwasher, is also referred to as a base support of the dishwasher and is the connecting part between a lower base, such as a foot or the base of a recess in a kitchen unit for example, and the tub of the dishwasher. The tub is fastened to this above the bottom assembly. The fluid collection apparatus is preferably the lowest termination of the dishwasher and with its one or more intermediate reservoirs and its main reservoir serves to hold fluid, in particular wash liquor fluid that runs out of the tub and/or another fluid-conducting component such as for example a circulation pump, drain pump, fluid circuit line, etc., due to leakage and/or through at least one overflow line when a permissible maximum level is exceeded. The fluid overflow safety unit is disposed in the main reservoir in such a manner that it triggers, as soon as fluid, in particular wash liquor fluid, gets into the main collection reservoir. The fluid overflow safety unit is provided so that, when fluid exits from the tub and/or another fluid-conducting component, the dishwasher and/or the area around the dishwasher cannot be damaged.

The respective intermediate reservoir serves in particular to buffer a certain quantity or volume of fluid, in particular wash liquor fluid, so that the fluid overflow safety unit does not trigger unnecessarily but the supplied fluid can evaporate. This fluid is generally formed by wash liquor fluid, i.e. water or leakage water, which contains dirt, floating matter and other impurities, such as for example food residues, fluff, dust and/or dishwasher detergent, dishwasher cleaning agents, rinse aid, salt particles, etc. The water that collects in the respective intermediate reservoir evaporates after a while and the floating matter, dirt and/or the other impurities, such as for example food residues, detergent, rinse aid, salt, etc. are deposited as sediment in the bottom region and/or as deposits in the side wall region of the respective intermediate reservoir and remain there. The respective intermediate reservoir therefore ensures that dirt, floating matter and other impurities, such as for example food residues, fluff, dust and/or dishwasher detergent, dishwasher cleaning agents, rinse aid, salt particles, etc. that may be contained in the leakage and/or overflow fluid can be deposited sufficiently on the bottom and/or on the side walls of the intermediate reservoir. This means that such sump products in the leakage and/or overflow fluid get into the main reservoir much less frequently or not at all, so that dirt, floating matter and/or other impurities are much less able or are unable to adhere to the fluid overflow safety unit, in particular to its float. This means that the functionality and trigger reliability of the fluid overflow safety unit is largely maintained for an emergency when a critical volume of fluid, in particular wash liquor, is exceeded in the respective intermediate reservoir, as can be held for evaporation and this excess fluid overflows into the main reservoir, in particular by way of the respective guide channel. Impairment of the correct movement of the fluid overflow safety unit, in particular its float element, by sump products fixed, suspended or adhering thereon is largely prevented. As a result the trigger reliability of the fluid overflow safety unit is largely maintained.

The guide channel between the respective intermediate reservoir and the main reservoir serves as an overflow from a certain quantity of fluid, in particular wash liquor, in the respective intermediate reservoir, which is greater than its capacity. The first end of the guide channel facing the intermediate reservoir here is disposed at a distance from a bottom region of the intermediate reservoir on a side wall of the intermediate reservoir. In other words the fluid is only conducted in a directed manner by way of the guide channel to the main reservoir of the fluid collection apparatus when a certain fill level or collectable maximum volume of fluid is exceeded in the intermediate reservoir. The bottom region of the respective intermediate reservoir is formed by the lower region of the intermediate reservoir. The bottom region can be configured differently. Thus the bottom region can be configured as flat or not flat, for example slightly arched.

The fluid is retained in the intermediate reservoir until it reaches the run-out level of the respective guide channel in the side wall of the intermediate reservoir. The side wall of the intermediate reservoir serves so to speak as a barrier, retaining a certain quantity of fluid in the intermediate reservoir to allow said fluid to evaporate in the intermediate reservoir due to ambient conditions.

According to one expedient development of the invention the fluid collection apparatus is configured as a flat bottom plate. The main reservoir and the one or more intermediate reservoirs are preferably molded in this as depressed hollows. The respective intermediate reservoir is preferably configured as an evaporation tray.

According to one expedient development of the invention the height level of each intermediate reservoir is higher than that of the main reservoir. Particularly preferred therefore is a reservoir which is characterized in that the bottom region of the respective intermediate reservoir is disposed closer to the tub of the dishwasher than the bottom region of the main reservoir. In other words the bottom region of the respective intermediate reservoir is disposed vertically higher than the bottom region of the main reservoir. This produces a gradient so that the fluid exiting from the intermediate reservoir can run independently into the main reservoir. The intermediate reservoir and the main reservoir are preferably disposed at levels of different heights. The bottom region of the main reservoir is preferably disposed at one of the lowest points of the fluid collection apparatus. The fluid overflow safety unit is advantageously provided at the lowest point of the main collection reservoir. This largely ensures that the excess fluid, in some instances overflowing out of the respective intermediate reservoir, is also conducted safely into the main reservoir, in particular to the fluid overflow safety unit. The respective intermediate reservoir can in particular be disposed in steps in the manner of a cascade above the main collection reservoir.

It can also be expedient for the respective intermediate reservoir and the main reservoir in particular to be integral components of the bottom plate of the bottom assembly. Integral component within the context of the invention means that neither the intermediate reservoir nor the main reservoir have to be disposed on the bottom assembly or on the bottom plate as additional elements at a later stage but are already made part of the bottom plate during production of the bottom plate. In other words integral means that the respective intermediate reservoir and the main reservoir are also generated directly during production of the bottom plate of the bottom assembly. This is preferably done using a casting procedure, in particular an injection molding procedure. Alternatively the bottom plate of the bottom assembly including the intermediate reservoir and the main reservoir can also be produced by means of a deep drawing procedure. The advantage of such an embodiment of the bottom plate, as well as the favorable production costs because separate reservoirs do not have to be produced, is the fact that there is no need to mount one or both reservoirs on the bottom plate of the bottom assembly. In other words there is no need for the costly and time-consuming attachment of the reservoir to the bottom plate. The bottom plate can be configured as a separate component of the bottom assembly or as an integral component of the bottom assembly.

It can in particular be expedient to produce the bottom assembly including the bottom plate as a fluid collection apparatus made of plastic. This allows simple and low-cost manufacture.

In a further expedient variant of the dishwasher provision can be made for the guide channel to be configured so that it tapers from the intermediate reservoir to the main reservoir. The guide channel is advantageously configured as an open channel. However it can also have a closed shape in the manner of a hollow profile, like a pipe for example. Because the guide channel tapers to the main reservoir, it is possible to conduct the water overflowing out of the intermediate reservoir in a directed manner even more efficiently. In other words the water exiting from the guide channel into the main reservoir can be guided precisely to where the float of the fluid overflow safety unit is disposed. The tapering or narrowing of the guide channel towards the main reservoir increases the flow speed of the overflowing water so that the water can be conducted quickly in the direction of the fluid overflow safety unit, thereby ensuring a fast response of the fluid overflow safety unit in the main collection reservoir. The tapering of the guide channel can be configured as conical for example. If the guide channel is configured in the manner of a hollow profile, the taper can be configured by constantly reducing the cross section of the guide channel towards the main reservoir.

Particularly preferred is a dishwasher, in which the first end of the guide channel, which is assigned to the respective intermediate reservoir, is disposed closer to the tub than a second end of the guide channel, which is assigned to the main reservoir, with the distance between the guide channel and the tub preferably increasing constantly from the first end to the second end of the guide channel. Such an arrangement of the guide channel means that the guide channel is disposed at an angle. In other words the guide channel features a gradient from the respective intermediate reservoir to the main reservoir. The gradient of the guide channel means that the fluid overflowing from the intermediate reservoir into the guide channel is conducted quickly and in a directed manner to the main reservoir, in particular to the fluid overflow safety unit of the main reservoir. Disposed closer to the tub means that the distance between the first end of the guide channel and the tub is smaller than the distance between the second end of the guide channel and the tub, opening into the main reservoir. The fluid overflowing from the respective intermediate reservoir therefore runs automatically due to gravity in the direction of a certain point, in particular into proximity to the fluid overflow safety unit, in the main collection reservoir.

As already set out, the guide channel can be configured differently. The guide channel between the respective intermediate reservoir and the main reservoir of the dishwasher can alternatively also be configured as a tapering depression in a separating wall between the two reservoirs. The two fluid collection reservoirs can be disposed directly adjacent to one another, only separated by a separating wall. In this advantageous variant the guide channel is not configured in an extending manner but is formed by a depression in the separating wall between the two reservoirs. The depression here is provided on the intermediate reservoir in such a manner that the fluid overflowing from the intermediate reservoir is conducted to a certain point of the main reservoir. The depression can in particular be a cutout in the side wall of the intermediate reservoir or container. The tapering shape of the depression ensures the directed flow of the overflowing water to the main reservoir.

It can also be advantageous if the bottom region of the respective intermediate reservoir features a flat horizontal extension or an approximately flat horizontal extension. Such an embodiment of the bottom region of the intermediate reservoir of the dishwasher ensures that the fluid exiting from the tub is distributed as evenly as possible over the entire bottom region of the intermediate reservoir so that the water can evaporate quickly. An approximately flat horizontal extension within the meaning of the invention means that the bottom region is only at a tiny angle or no angle at all, for example between 0° and 2 degrees, to a horizontal plane. It can be particularly preferable here for the lowest point of the bottom region not to be assigned to the first end of the guide channel but to be at a minimum distance from this. This means that sump products, when they occur, are not deposited directly in front of the guide channel, so the entrance into the guide channel remains clear for the fluid.

It may be particularly expedient for evaporation to select a ratio of the longitudinal and/or transverse extension of the collection surface of the respective intermediate reservoir to its depth of more than 3:1, in particular between 5:1 and 8:1, preferably more than 10:1.

Also particularly preferred is a dishwasher, in which the ratio of the flat horizontal extension or the approximately flat horizontal extension of the bottom region of the intermediate reservoir to the depth of the intermediate reservoir is more than 5:1, in particular more than 10:1. In other words in relation to an x, y, z coordinate system the horizontal extension in an x direction and a y direction is much greater than the depth of the intermediate reservoir, i.e. the extension of the intermediate reservoir in a z direction perpendicular to the x and y directions. This ensures that the intermediate reservoir is not configured to be high but advantageously flat. The bottom region of the intermediate reservoir is therefore configured over a large surface, so that the fluid conducted to the intermediate reservoir from the tub and/or another fluid-conducting component can evaporate as quickly as possible. In particular a flat horizontal extension of the bottom region advantageously ensures that the water is distributed evenly in the bottom region. A further advantage of such an embodiment of the bottom region of the intermediate reservoir is that the intermediate reservoir does not have to have too great a depth, which in turn keeps the structural height of the fluid collection apparatus, in particular the bottom plate, of the bottom assembly of the dishwasher, in particular of the household dishwasher, small. A bottom region of the intermediate reservoir that is configured as flat can preferably extend over most of the base surface of the bottom plate of the bottom assembly. The larger the bottom region of the intermediate reservoir is configured, the smaller the depth of the intermediate reservoir can be configured and the quicker fluid leaving the tub and being conducted to the intermediate reservoir can evaporate in said intermediate reservoir.

A filter element covering the cross section of the guide channel can optionally also be provided on the guide channel. A dishwasher thus configured is particularly reliable in respect of fluid overflow safety. The filter element filters impurities out of the leakage fluid and/or overflow fluid, which float on the surface of the exited fluid. It can always happen that because of its composition dirt floats on the surface of the fluid collected in the intermediate reservoir and cannot be deposited as sump products on the bottom region of the intermediate reservoir. The filter element covering the cross section of the guide channel is provided so that this dirt cannot get to the main reservoir and therefore to the fluid overflow safety unit, when the fluid overflows out of the main reservoir. The filter element here can be configured in different sizes. The filter element can be a relatively coarse-meshed grating for example, which retains larger impurities. As a result these can be deposited below the fluid overflow safety unit, in particular below its float element, to a far lesser degree or not at all, thereby also not having a negative effect on the response and/or trigger behavior of the fluid overflow safety unit. The adhesion of impurities to the float can also be prevented more effectively by the filter element.

A dishwasher, in which according to a further expedient variant a closable drain opening is provided in a side wall of the bottom assembly, facing the intermediate reservoir, allows simple removal of sump products remaining in the intermediate reservoir. Such a closable drain opening is preferably provided on the front wall of the bottom assembly, disposed below the door of the tub of the dishwasher. This means that the drain opening is generally easily accessible, without having to move the dishwasher. Emptying the intermediate reservoir ensures that it maintains its full functionality. If deposited sump products were not removed from the intermediate reservoir, the fluid holding capacity of the intermediate reservoir would gradually decrease, so that very little leakage fluid and/or overflow fluid would cause the fluid to overflow to the main reservoir and as a result the fluid overflow safety unit would be triggered unnecessarily.

A dishwasher can also be expedient, in which two or more intermediate reservoirs are each provided with a guide channel between each intermediate reservoir and the main reservoir. In other words water exiting from the tub in an unwanted manner can be conducted to two or more intermediate reservoirs. This allows the bottom region of the intermediate reservoir, i.e. the size of the bottom region of all the intermediate reservoirs, to be enlarged again so that even more efficient evaporation of the overflow and/or leakage fluid can take place. Each intermediate reservoir is connected by way of at least one guide channel to the main reservoir of the collection apparatus, in particular to the bottom plate of the bottom assembly. The guide channels between the intermediate reservoirs and the main reservoir can be configured differently here. All the intermediate reservoirs are preferably disposed higher than the main reservoir on the bottom plate. The guide channels advantageously all have a gradient to the main collection reservoir so that fluid overflowing from the intermediate reservoirs can be conducted quickly and in a directed manner to the main collection reservoir due to gravity.

The bottom plate of the bottom assembly of the dishwasher is preferably made of metal or plastic. Complicated bottom plate shapes are preferably made of plastic, for example using a casting procedure, in particular using an injection molding procedure. The bottom plate can also be produced using a deep drawing procedure. If the bottom plate is an integral component of the bottom assembly, the entire bottom assembly is preferably produced using a casting procedure or a deep drawing procedure.

It can in particular also be expedient in some instances to provide at least one guide channel between at least a first intermediate reservoir and at least a second intermediate reservoir, according to the variants of the guide channel described above between the respective intermediate reservoir and the main reservoir. This channeling or in general terms cross-linking or intercommunication between the intermediate reservoirs allows excess fluid to be distributed from the respective intermediate reservoir to one or more intermediate reservoirs. I is thus possible to prevent an intermediate reservoir, the capacity of which is too small to hold fluid overflowing from the tub and/or another fluid-conducting component, from overflowing into the main reservoir. This prevents fluid getting into the main reservoir unnecessarily and its fluid overflow safety unit responding.

Other developments of the invention are set out in the subclaims.

BRIEF DESCRIPTION OF THE DRAWINGS

The invention and its developments and their advantages are described in more detail below with reference to drawings, in which.

DETAILED DESCRIPTION OF EXEMPLARY EMBODIMENTS OF THE PRESENT INVENTION

Figure 1:
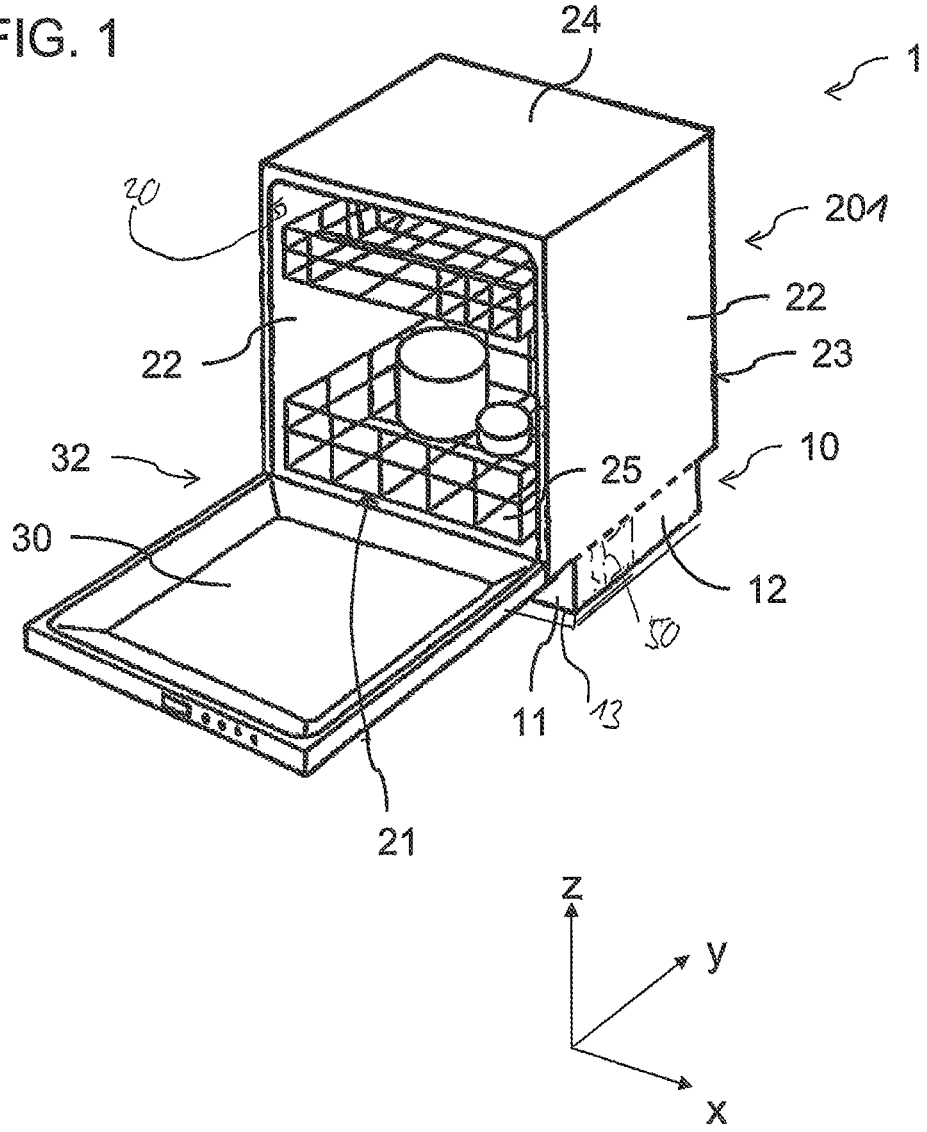
FIG. 1 shows a schematic diagram of a perspective view of an advantageous exemplary embodiment of a household dishwasher, below the tub of which a bottom assembly is provided, having a bottom plate, in particular a bottom collecting trough, according to the inventive design principle.
Figure 2:
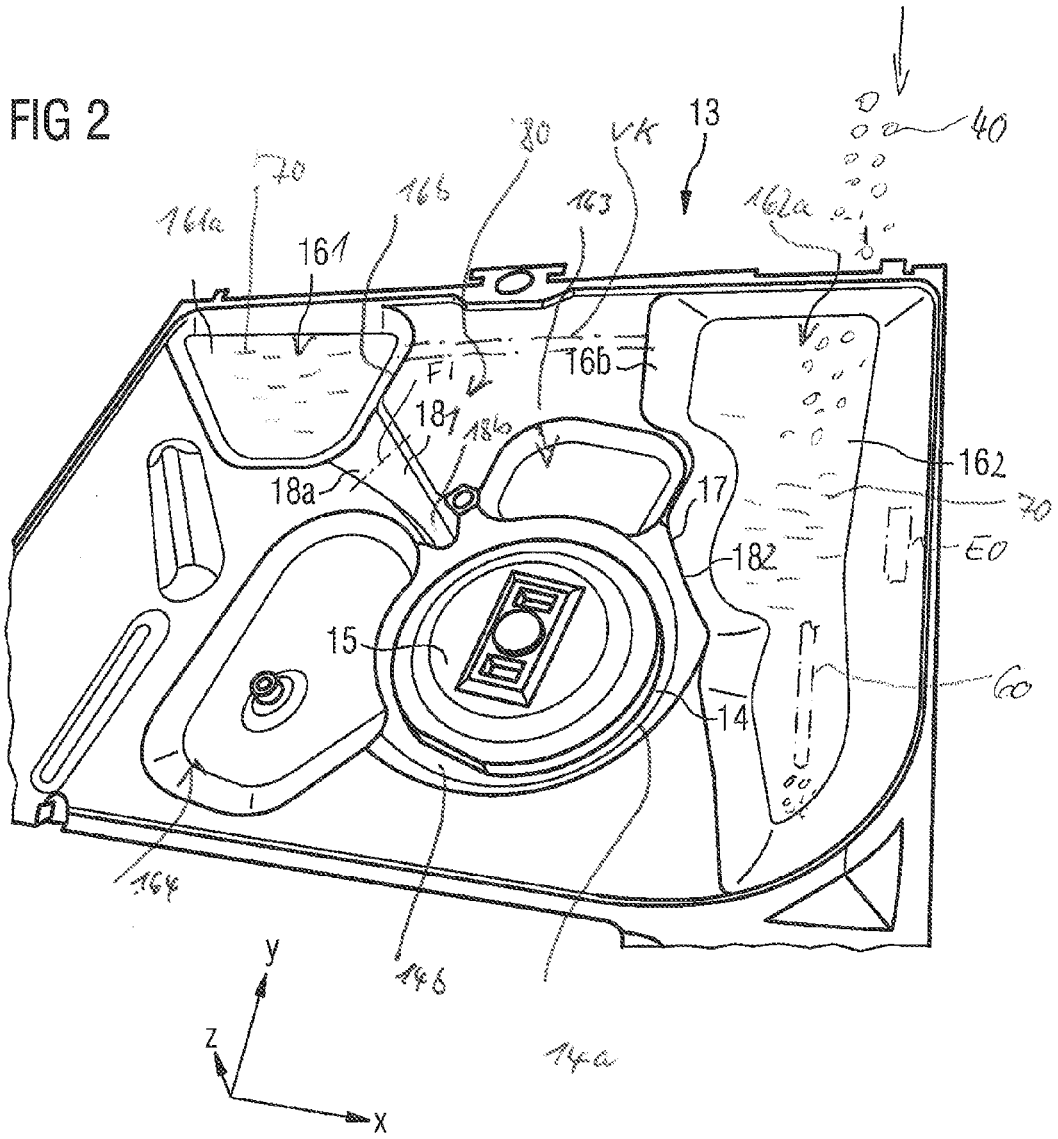
FIG. 2 shows a detailed schematic diagram of a perspective view of the bottom plate as a detail of the bottom assembly of the household dishwasher from FIG. 1.

Elements of identical function and mode of operation are shown with the same reference characters respectively in FIGS. 1 and 2.

FIG. 1 shows a schematic diagram of a perspective view of an advantageous exemplary embodiment of a household dishwasher 1, the bottom assembly 10 of which features a bottom plate 13 (see FIG. 2) configured as a fluid collection apparatus according to the inventive design principle for collecting any leakage and/or overflow fluid exiting from its tub 20 and/or one or more fluid-conducting components, in particular hydraulic components such as for example a circulation pump, drain pump, fluid circuit lines, etc. These components are only shown schematically in FIG. 1 by means of a dot-dash block marked with the reference character 50. The tub 20 is positioned above and on the bottom assembly 10. It is therefore disposed above the bottom assembly 10 when viewed in the height direction or z direction of a Cartesian x, y, z coordinate system shown in FIG. 1. In other words the bottom assembly 10 is provided below the tub 20. It is enclosed by an outer housing 201.

The bottom assembly 10 establishes contact with a lower base, in particular a foot, at the respective installation site of the household dishwasher 1. Below the tub 20 it has a front element running across in the x direction, in particular a front wall 11 and side elements adjoining this and extending in the depthwise direction y, in particular side walls 12. The front element 11 and the side elements 12 and a rear element (not shown), in particular a rear wall, form the structural frame of the bottom assembly 10. It is closed by a top element 25 resting thereon.

The tub 20 comprises a U-shaped hood, made up of a tub top wall 24 and two side walls 22 molded laterally thereto as arm elements. Attached to the rear of this U-shaped hood is a tub rear wall 23. Its tub bottom wall is formed here in the exemplary embodiment by the top element 25 of the bottom assembly 10. The box-type tub 20 thus constructed features a front, rectangular loading opening 21, which can be closed off by a pivotably supported door 30. In the exemplary embodiment here this is supported pivotably on the two side walls 12 of the bottom assembly or base support unit 10, which extend in the depthwise direction y.

A metallic material, in particular a corrosion-resistant material such as stainless steel, preferably chrome-nickel steel, is preferably selected for the U-shaped hood and rear wall 23. In contrast the box-type, in particular rectangular, structural frame and the top element of the bottom assembly are preferably made of plastic, which simplifies production. Thus in the present exemplary embodiment together they preferably form a single-piece or one-part base support unit, in which the various components of the bottom assembly can be housed. In some instances further components, e.g. a pump sump or line guides, can also be molded on this base support unit, preferably monolithically. The base support unit can advantageously be produced using a plastic injection molding procedure, which is particularly simple and economical.

Below its fluid-conducting components such as the pump sump, circulation pump and/or drain pump, and/or fluid supply/fluid discharge lines, etc. of the fluid circulation system, the bottom assembly 10 below the tub 20 features a bottom plate 13 as a lower terminating element close to the bottom. This bottom plate 13 is configured as a safety collection trough for leakage and/or overflow fluid that may exit from the tub and/or from one or more fluid-conducting components. The flat bottom plate 13 is shown schematically in a detailed perspective view in FIG. 2. Any exiting fluid is in particular wash liquor fluid, wash liquor fluid vapor and/or condensate thereof. Depending on the program step of the respectively ongoing dishwashing program the wash liquor fluid can in particular be fresh water, clear water, gray water, used water, in other words dirty water produced by soiled items being washed in the respective cleaning operation, with or without one or more detergent, salt and/or rinse aid substances. It can in some instances also contain solid particles such as for example dirt, floating matter and/or other impurities, such as fluff, dust and/or dishwasher detergent residues, cleaning agent residues, rinse aid residues, salt particles, food residues, etc.

In the household dishwasher in the present exemplary embodiment fluid exiting in an unwanted manner from the tub 20 above the bottom assembly 10, i.e. leakage fluid 40 dripping down to the bottom from the tub 20 and/or overflow fluid running down out of the tub 20 by way of a supply line 60 only shown with a dot-dash line in FIG. 2 for the clarity of the drawing, when a predetermined level top limit is exceeded, is conducted to the bottom assembly 10.

The bottom plate 13 in FIG. 2 features a tray or hollow-shaped main reservoir 14, in the bottom region of which, preferably at the deepest point of the bottom region, a fluid or liquid overflow safety unit 15 is disposed. The main reservoir 14 is preferably positioned in the region below the pump sump of the tub 20. The fluid overflow safety unit 15 in particular features a float element. As soon as the float reaches a certain permissible level height due to leakage and/or overflow fluid flowing into the main reservoir 14, the fluid overflow safety unit 15 triggers and stops the water supply to the tub 20 of the dishwasher 1. A drain pump is also generally activated to pump off and therefore drain the wash liquor out of the tub 20 and/or fluid circuit of the dishwasher 1.

In addition to the main reservoir 14 the bottom plate 13 additionally features a number of, in the present exemplary embodiment in particular two, intermediate reservoirs 161, 162, each configured to be open at the top and in the shape of a tray or hollow. The respective additional intermediate reservoir 161, 162 is provided in a spatially separate manner at a different location from the main reservoir 14 outside it in the fluid collection apparatus 13. The intermediate reservoirs serve to hold fluid exiting in an unwanted manner, in particular wash liquor fluid, fluid vapor and/or condensate from the tub 20. For example such a fluid can be conducted out of the tub 20 when a predetermined level top limit is exceeded through at least one discharge line, such as 60 for example, to the intermediate reservoirs 161, 162. Additionally or independently hereof the respective intermediate reservoir can also be used to collect leakage fluid dripping from the tub 20, in particular in the region of the joint between its U-shaped hood and/or rear wall 23 and/or the top element 25 of the bottom assembly 10. The respective reservoir can also be used to collect condensate from the tub, for example when the door 30 of the tub 20 is opened briefly during operation of the dishwasher 1. Moist bursts of steam escape from the tub 20 in this process. The exiting condensate is collected and conducted by way of a supply line (not shown in FIGS. 1, 2 for the simplicity of the drawing) into one of the intermediate reservoirs or into both intermediate reservoirs 161, 162.

The intermediate reservoirs 161, 162 and the main reservoir 14 are each configured as open at the top and flat, in other words they each have a large bottom region 161*a*, 162*a*, 14*a* but not very high side walls 16*b*. In other words they are shallow. The bottom regions 16*a* of the intermediate reservoirs 161, 162 are preferably configured as flat and have a horizontal extension. Horizontal extension means that the bottom regions 16*b* extend along the x and y directions of the x, y, z coordinate system illustrated. The bottom region 16*a* of the respective intermediate reservoir 161, 162 is preferably at least 5 times to 10 times as long in the x direction and y direction as the height of the side wall 16*b* of said intermediate reservoir. Such a flat tray-shaped or hollow-shaped embodiment of the intermediate reservoir 161, 162 permits particularly efficient evaporation of the fluid conducted into the intermediate reservoirs. Impurities in the fluid are generally deposited in the bottom region 161*a*, 162*a* of the respective intermediate reservoir 161, 162 as what are known as sump products. These can be removed from the intermediate reservoirs 16 by way of corresponding drain openings in the side walls 12 or front wall 11 of the bottom assembly 10. FIG. 2 shows such a drain opening with a dot-dash line marked EO.

The intermediate reservoirs 161, 162 serve to hold any fluid exiting in an unwanted manner downwards out of the tub 20, in particularly dripping out, so that it does not get directly into the main reservoir 14 and trigger the fluid overflow safety unit 15 there unnecessarily. The embodiment of the bottom region 16*a* of the intermediate reservoirs 161, 162 with a large surface allows relatively fast evaporation of the collected fluid. Disposed between each intermediate reservoir 161, 162 and the main collection reservoir 14 in each instance is a guide channel 181, 182. In some instances the intermediate reservoirs, e.g. 161, 162, can also be connected together by way of at least one channel in the same way as the respective intermediate reservoir is connected to the main reservoir. This allows distribution of the fluid stored in an intermediate reservoir to one or more other intermediate reservoirs. In particular the several intermediate reservoirs can communicate with one another by way of at least one connecting channel from one intermediate reservoir to the next intermediate reservoir in such a manner that fluid equalization can be ensured. In the exemplary embodiment in FIG. 2 such a connecting channel between the two intermediate reservoirs 161, 162 is only shown with a dot-dash line and marked VK.

The guide channels serve to conduct the fluid on in a fast and directed manner from the intermediate reservoirs 161, 162 that are open at the top to the main reservoir 14 when more fluid exits from the tub 20 and/or at least one fluid-conducting component than the intermediate reservoirs 161, 162 can hold. The first end 18*a* of the guide channel 181 facing the first, smaller intermediate reservoir 161 is disposed at a distance from the bottom region 161*a* of the first intermediate reservoir 161 on a side wall 16*b* of said intermediate reservoir 161. It can in particular be provided in the region of the top edge of the first intermediate reservoir 161 that is open at the top. As a result fluid, in particular wash liquor fluid, only overflows into the main reservoir 14 from a certain fluid level height (in particular one that is not zero cm) in the first intermediate reservoir 161. The fast and directed conducting of the fluid overflowing from the first intermediate reservoir 161 to the main reservoir 14 allows a correspondingly fast triggering of the fluid overflow safety unit 15 in an emergency. The guide channel 181 between the smaller, first intermediate reservoir 161 and the main reservoir 14 has a tapering shape in the direction of the main reservoir 14. In this exemplary embodiment of the dishwasher 1 the bottom regions 16*a* of the first intermediate reservoir 161 are disposed closer to the tub 20 than the bottom region of the main reservoir 14. The guide channel 181 therefore features a gradient between the smaller intermediate reservoir 161 and the main reservoir 14 in the direction of the main reservoir 14. The fluid overflowing from the small intermediate reservoir 161 is therefore conducted in an accelerated manner through the guide channel 181 to the main reservoir 14. The first end 18*a* of the guide channel 18 is disposed higher in the z direction than the second end 18*b* of the guide channel 18. This means that fluid overflowing out of the small intermediate reservoir 161 flows quickly to the main reservoir 14.

In contrast to the first intermediate reservoir 161 the larger, second intermediate reservoir 162 and the main collection reservoir 14 are separated from one another by a separating wall 17. The guide channel 182 between the larger intermediate reservoir 162 and the main collection reservoir 14 is formed by a depression in the separating wall 17 that tapers in the flow direction. This depression allows overflowing fluid to be conducted from the larger intermediate reservoir 16 to the main collection reservoir 14.

The guide channels 181, 182 of the first and second intermediate reservoirs are therefore configured differently.

The fluid overflow safety unit 15 in the main reservoir 14 allows operation of the dishwasher to be stopped and in some instances wash liquor to be pumped off from the tub and/or fluid circuit of the dishwasher by means of its drain pump, as soon as the leakage and/or overflow fluid collected in at least one of the several intermediate reservoirs exceeds the collectable maximum volume predetermined by the respective intermediate reservoir, i.e. its capacity, and overflows out of said intermediate reservoir into the main reservoir.

The flat, in particular tray-shaped or hollow-shaped embodiment of the intermediate reservoirs 161, 162 and of the likewise shallow main reservoir 14 allows the bottom plate 13 of the bottom assembly 10 to be configured as very flat, in particular trough-shaped or tray shaped. In other words the depth of the bottom plate 13 and therefore of the bottom assembly 10 can be configured as relatively small. This has the advantage for example that it can be housed as a lower terminating element in a small space in the bottom assembly. The structural height of the bottom assembly can thus be kept lower than previously and more space is available for the tub 20 of the dishwasher 1.

The intermediate reservoirs 161, 162 and the main collection reservoir 14 are preferably integral components of the bottom plate 13. In other words they are generated as a single piece with the bottom plate 3 during production of the bottom plate 13. The intermediate reservoirs 161, 162, the main collection reservoir 14 and the bottom plate 13 are therefore cast, injected or deep drawn as a single piece and from the same material, in particular plastic. This reduces production costs, as additional intermediate reservoirs 161, 162 do not have to be made separately and be disposed in the bottom assembly as individual elements. The mounting outlay is also clearly lower, as intermediate reservoirs 161, 162 do not have to be fastened to the bottom plate 13 later.

A filter element can additionally be disposed on each of the guide channels, e.g. 181 here. Such a filter element is only shown with a dot-dash line for clarity of the drawing in FIG. 2 and marked Fl, in the case of the guide channel 18 between the smaller intermediate reservoir 161 and the main reservoir 14. It extends advantageously over the throughflow cross section of the guide channel 18 so that impurities floating on the surface can be filtered out and retained in the intermediate reservoir 181 and cannot therefore get into the main collection reservoir 14. This ensures that the fluid overflow safety unit 15 in the main reservoir 14 remains fully functional for a long time. No or barely any sump products are therefore deposited below the fluid overflow safety unit 15, in particular below its float element, so they are barely or not at all able to have a negative influence on the fluid overflow safety unit 15.

To summarize therefore according to the advantageous exemplary embodiment in FIGS. 1, 2 a household dishwasher 1 is provided having a bottom assembly 10 below its tub 20, featuring at least one fluid collection apparatus 13 for collecting leakage and/or overflow fluid 40 from the tub 20 and/or from at least one fluid-conducting component 50. The fluid collection apparatus 13 here comprises a main reservoir 10 having a fluid overflow safety unit 15 and one or more additional intermediate reservoirs 161, 162. The one or more additional intermediate reservoirs 161, 162 for collecting leakage fluid and/or overflow fluid 40 from the tub 20 and/or the respectively fluid-conducting component 50 are disposed and configured in such a manner that solid particles 70 contained in the leakage and/or overflow fluid 40 can largely be deposited and/or retained in the one or more intermediate reservoirs 161, 162. The respective additional intermediate reservoir 161, 162 is provided in a spatially separate manner at a different location from the main reservoir 14 outside it in the fluid collection apparatus 13.

The leakage and/or overflow fluid 40 can be collected in the respective intermediate reservoir 161, 162 up to a predetermined fill level top limit, in particular for evaporation purposes, and only flows out of the respective intermediate reservoir 161, 162 into the main reservoir 14 when the fill level top limit is exceeded. The height level of the fill level top limit of the respective intermediate reservoir 161, 162 is expediently higher than the bottom region 14*a* of the main reservoir 14 so that a gradient is formed between the respective intermediate reservoir and the main reservoir. To this end it is particularly expedient if the bottom region 161*a*, 162*a* of the respective intermediate reservoir 161, 162 is disposed closer to the tub 20 than the bottom region 14*a* of the main reservoir 14. In other words therefore it is expedient if the bottom region 161*a*, 162*a* of the respective intermediate reservoir is higher than the bottom region 14*a* of the main reservoir 14. Additionally or independently hereof the bottom regions 161*a*, 162*a* of the intermediate reservoirs 161, 162 can be disposed at different height levels.

The respective intermediate reservoir 161, 162 and the main reservoir 14 in the present exemplary embodiment are preferably integral components of the fluid collection apparatus 13 of the bottom assembly 10. The main reservoir 14 and/or the one or more intermediate reservoirs 161, 162 are in particular molded in a common, flat, in particular trough-shaped or basin-shaped bottom element or bottom plate element in the manner of hollows that are open at the top or flat, tray-shaped depressions. The bottom region 161*a*, 162*a* of the respective intermediate reservoir 161, 162 and/or main reservoir 14 here can expediently take up an essentially flat, in particular horizontal, positional plane. The ratio of the longitudinal and/or transverse extension of the bottom region 161*a*, 162*a* of the respective intermediate reservoir 161, 162 to its depth is expediently selected to be more than 3:1, in particular between 5:1 and 8:1, particularly preferably more than 10:1. The resulting surface enlargement of the respective intermediate reservoir improves the evaporation of the fluid stored, in particular standing, therein.

Each intermediate reservoir 161, 162 is connected to the main reservoir 14 by way of at least one run-off, in particular guide channel 181, 182, to conduct fluid 40 out of the respective intermediate reservoir 161, 162 when its fill level top limit is exceeded into the main reservoir 14. The guide channel 181, 182 advantageously features a gradient from the respective intermediate reservoir 161, 162 to the main reservoir 14. It can in particular be expedient if the guide channel 18 is configured to taper from the respective intermediate reservoir 161, 162 to the main reservoir 14. In particular the first guide channel 181 extends from its inlet-side first end 18*a*, which is assigned to the intermediate reservoir 161, as a surface indentation in an elevated part 80 of the fluid collection apparatus 13, to its outlet-side end 18*b*, which is assigned to the main reservoir 14. Alternatively the second guide channel 18 is configured as a depression tapering in the flow direction in a separating wall 17 between the main collection reservoir 14 and the second intermediate reservoir 161, 162. A filter element Fl covering its throughflow cross section can in some instances also be provided on the respective guide channel, for example 181 here. In some instances at least one additional connecting channel VK can optionally be provided between the two intermediate reservoirs 161, 162, to allow equalization of the collected fluid.

LIST OF REFERENCE CHARACTERS

1 Dishwasher
10 Bottom assembly
11 Front wall of bottom assembly
12 Side wall of bottom assembly
13 Fluid collection apparatus, in particular bottom plate of bottom assembly
14 Main reservoir
14*a* Bottom region of main reservoir
15 Fluid overflow safety unit
16 Intermediate reservoir
161*a*, 162*a* Bottom region of intermediate reservoir
16*b* Side wall of intermediate reservoir
17 Separating wall
181, 182 Guide channel
18*a* First end of guide channel
18*b* Second end of guide channel
20 Tub
201 Outer housing
21 Front
22 Tub side wall
23 Tub rear wall
24 Tub top wall
25 Tub bottom wall
Fl Filter element
EO Drain opening
VK Connecting channel
30 Door
32 Pivot region of door
40 Leakage and/or overflow fluid
50 Circulation pump
60 Overflow supply line
70 Solid particles
80 Elevated part of fluid collection apparatus

The invention claimed is:

1. A dishwasher, comprising:

a tub to accommodate items to be washed; and a bottom assembly disposed below the tub and including at least one fluid collection apparatus which comprises a main reservoir having a fluid overflow safety unit and at least one additional intermediate reservoir for collecting leakage and/or overflow fluid from at least one member selected from the group consisting of the tub and at least one fluid-conducting component, said at least one additional intermediate reservoir being disposed and configured in such a manner that solid particles contained in the leakage and/or overflow fluid can largely be deposited and/or retained in the at least one additional intermediate reservoir, said at least one additional intermediate reservoir being connected to the main reservoir by at least one run-off to conduct fluid out of the at least one additional intermediate reservoir into the main reservoir when a predetermined fill level top limit in the at least one additional intermediate reservoir is exceeded, said runoff having a gradient from the at least one intermediate reservoir to the main reservoir.

2. The dishwasher of claim 1, constructed in the form of a household dishwasher.

3. The dishwasher of claim 1, wherein the run-off is a guide channel.

4. The dishwasher of claim 1, wherein the at least one additional intermediate reservoir is constructed to collect leakage and/or overflow fluid up to the predetermined fill level top limit, and to conduct leakage and/or overflow fluid from the at least one additional intermediate reservoir into the main reservoir only when the fill level top limit is exceeded.

5. The dishwasher of claim 4, wherein the at least one additional intermediate reservoir is constructed to evaporate leakage and/or overflow fluid.

6. The dishwasher of claim 1, wherein the fill level top limit of the at least one additional intermediate reservoir has a height level which is higher than a bottom region of the main reservoir.

7. The dishwasher of claim 1, wherein the solid particles are formed by at least one member selected from the group consisting of floating matter, dirt particles, impurities, detergent, rinse aid, salt residues, and other sump products.

8. The dishwasher of claim 7, wherein the sump products include food residues, dust particles, fluff.

9. The dishwasher of claim 1, wherein the fluid overflow safety unit comprises a float unit.

10. The dishwasher of claim 1, wherein the at least one fluid collection apparatus has a plurality of said additional intermediate reservoir, at least one of the additional intermediate reservoirs having a bottom region which is disposed at a different height level than a bottom region of the main reservoir.

11. The dishwasher of claim 1, wherein the at least one additional intermediate reservoir is disposed closer to the tub than a bottom region of the main reservoir.

12. The dishwasher of claim 1, wherein the at least one fluid collection apparatus has at least two of said additional intermediate reservoir, wherein a bottom region of one of the two additional intermediate reservoirs is disposed at a different height level than a bottom region of the other one of the two additional intermediate reservoirs.

13. The dishwasher of claim 1, wherein the at least one additional intermediate reservoir and the main reservoir are integral components of the fluid collection apparatus of the bottom assembly.

14. The dishwasher of claim 1, wherein at least one member selected from the group consisting of the main reservoir and the at least one additional intermediate reservoir is molded in a common, flat bottom element or bottom plate element in a manner of hollows or flat, tray-shaped depressions.

15. The dishwasher of claim 14, wherein the bottom element or bottom plate has a trough-shaped configuration.

16. The dishwasher of claim 1, wherein the at least one additional intermediate reservoir has a first bottom region and the main reservoir has a second bottom region, at least one the first and second bottom regions extending in an essentially flat positional plane.

17. The dishwasher of claim 16, wherein the positional plane is horizontal.

18. The dishwasher of claim 1, wherein the at least one additional intermediate reservoir has a bottom region defined by a longitudinal extension and a transverse extension, wherein a ratio of at least one member selected from the group consisting of the longitudinal extension and the transverse extension of the bottom region to a depth of the at least one additional intermediate reservoir is selected to be more than 3:1.

19. The dishwasher of claim 1, wherein the ratio is between 5:1 and 8:1.

20. The dishwasher of claim 1, wherein the ratio is more than 10:1.

21. The dishwasher of claim 1, wherein the at least one additional intermediate reservoir is provided in the fluid collection apparatus in a spatially separate manner at a different location from the main reservoir outside the main reservoir.

22. The dishwasher of claim 3, wherein the guide channel is configured to taper from the at least one additional intermediate reservoir to the main reservoir.

23. The dishwasher of claim 3, wherein the guide channel extends from an inlet-side first end, which is assigned to the at least one additional intermediate reservoir, as a surface indentation in an elevated part of the fluid collection apparatus, to an outlet-side end, which is assigned to the main reservoir.

24. The dishwasher of claim 3, wherein the guide channel is configured as a tapering depression in a separating wall between the main reservoir and the at least one additional intermediate reservoir.

25. The dishwasher of claim 3, further comprising a filter element provided on the guide channel and covering a throughflow cross section of the guide channel.

26. The dishwasher of claim 1, further comprising at least one overflow supply line provided between the tub and the at least one additional intermediate reservoir to conduct fluid from the tub to the at least one additional intermediate reservoir when a level top limit in the tub is exceeded.

27. The dishwasher of claim 26, wherein the fluid is a liquid.

28. The dishwasher of claim 1, wherein the at least one fluid collection apparatus has at least two of said additional intermediate reservoir, and further comprising at least one connecting channel provided between the at least two additional intermediate reservoirs.

* * * * *

UNITED STATES PATENT AND TRADEMARK OFFICE

CERTIFICATE OF CORRECTION

PATENT NO. : 9,101,254 B2
APPLICATION NO. : 13/320915
DATED : August 11, 2015
INVENTOR(S) : Ismael Jesus Almendros Carmona et al.

It is certified that error appears in the above-identified patent and that said Letters Patent is hereby corrected as shown below:

Title Page, Item (73) Assignee should read

(73) Assignee: BSH Hausgeraete GmbH, Munich (DE)

Signed and Sealed this
Twenty-second Day of March, 2016

Michelle K. Lee

Michelle K. Lee
*Director of the United States Patent and Trademark Office*